US008221079B2

(12) United States Patent
Lin

(10) Patent No.: US 8,221,079 B2
(45) Date of Patent: Jul. 17, 2012

(54) PROPELLER FOR BOAT

(75) Inventor: Yeun-Junn Lin, Taichung (TW)

(73) Assignee: Solas Science and Engineering Co., Ltd., Taichung (TW)

( * ) Notice: Subject to any disclaimer, the term of this patent is extended or adjusted under 35 U.S.C. 154(b) by 557 days.

(21) Appl. No.: 12/354,405

(22) Filed: Jan. 15, 2009

(65) Prior Publication Data

US 2010/0074756 A1 Mar. 25, 2010

(30) Foreign Application Priority Data

Sep. 25, 2008 (TW) ..... 97217355 U

(51) Int. Cl.
*B63H 1/20* (2006.01)

(52) U.S. Cl. ..... 416/93 A; 416/245 A

(58) Field of Classification Search ..... 416/93 A, 416/133, 155, 245 A, 246
See application file for complete search history.

(56) References Cited

U.S. PATENT DOCUMENTS 3,099,320 A * 7/1963 Simshauser ..... 416/138
3,788,267 A * 1/1974 Strong ..... 440/66

* cited by examiner

*Primary Examiner* — Cheung Lee
(74) *Attorney, Agent, or Firm* — Browdy and Neimark, PLLC

(57) ABSTRACT

A propeller for a boat includes a hub having a tail portion with an outlet, and a plurality of blades equiangularly disposed on the hub. The outer periphery of the tail portion defines with a center axis of the hub a distance gradually decreasing toward the outlet. Thus, the propeller has the advantages of reducing the drag and increasing the propulsive force of the boat when it rotates.

4 Claims, 2 Drawing Sheets

PROPELLER FOR BOAT

BACKGROUND OF THE INVENTION

1. Field of the Invention

The present invention relates generally to a propeller for use in a boat and more specifically, to a propeller that can increase the propulsive force of the boat.

2. Description of the Related Art

FIGS. 1 and 2 show a propeller 10 according to a prior art. The propeller 10 includes a hub 12, a plurality of blades 14 equiangularly disposed on an outer periphery of the hub 12, and an end cover 16 engaged with a tail 122 of the hub 12 and having an outer periphery defining with a center axis 124 of the hub 12 a distance gradually increasing away from the tail 122.

When the propeller 10 is driven by an engine to rotate, vortices will be generated by the rotation of the blades 14 and shed downstream, and simultaneously the waste gas produced from the engine will be exhausted out of an outlet 128 of the hub 12 through a center hole 126 of the hub 12.

However, because the end cover 16 is gradually expanded in its external diameter, the water flowing along the outer periphery of the end cover 16 will interfere with the waste gas exhausted out of the outlet 128 to cause turbulence, resulting in increase of drag and decrease of thrust force for propulsion of a watercraft when the propeller 10 rotates. Further, the end cover 16 and the hub 12 are manufactured individually and engaged with each other, resulting in that the propeller 10 has high manufacturing cost, and the end cover 16 may be disengaged from the hub 12 after a long time of use because the junction of the end cover 16 and the hub 12 will corrode in seawater. Thus, it is desirable to provide a propeller that can eliminate the aforesaid drawbacks.

SUMMARY OF THE INVENTION

The present invention has been accomplished in view of the above-noted circumstances. It is therefore one objective of the present invention to provide a propeller for a boat, which can decrease drag and increase the propulsive force of the boat when it rotates.

It is another objective of the present invention to provide a propeller for a boat, which is an integrated design to reduce manufacturing cost and enhance structural strength.

To achieve these objectives of the present invention, the propeller comprises a hub defining a center axis and having a tail portion with an outlet, and a plurality of blades equiangularly disposed on an outer periphery of the hub. The outer periphery of the tail portion defines with the center axis of the hub a distance gradually decreasing toward the outlet.

As a result, the waste gas exhausted out of the outlet of the hub will draw the water flowing along the outer periphery of the tail portion so as to increase the propulsive force of the boat; and moreover, the propeller of the present invention is an integrated design to effectively reduce manufacturing cost and enhance structural strength.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 2:
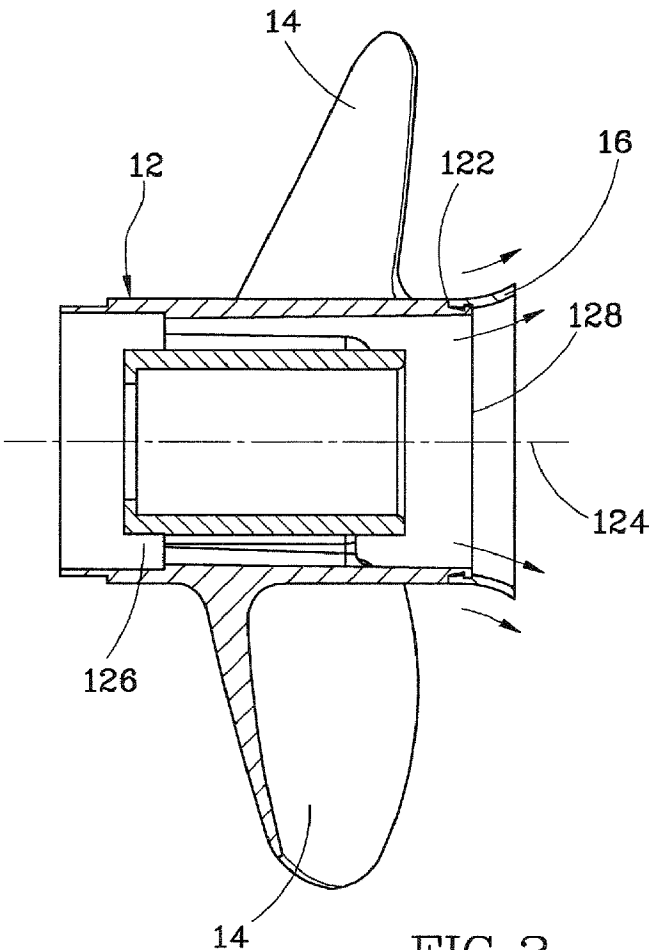
FIG. 2 PRIOR ART
FIG. 2 is a longitudinal sectional view of the propeller according to the prior art.
Figure 1:
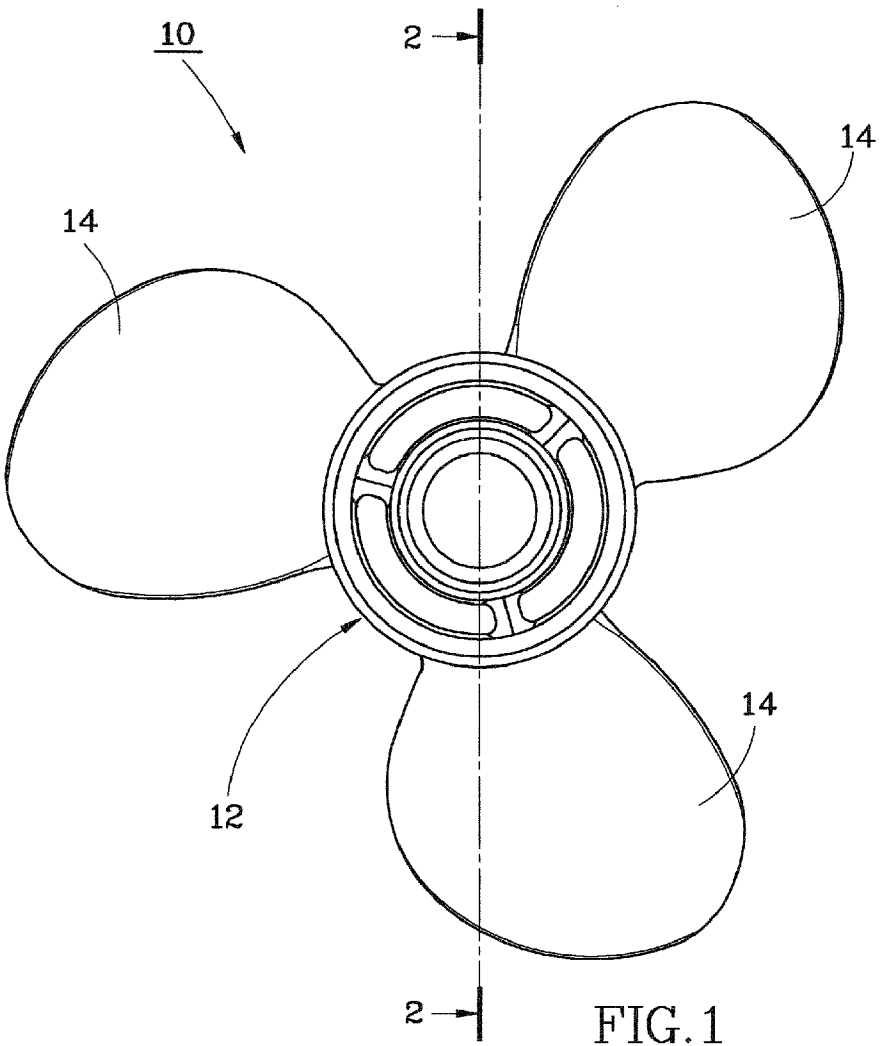
FIG. 1 PRIOR ART
FIG. 1 is an end view taken along a line 2-2 indicated in FIG. 1 of a propeller according to a prior art.
Figure 3:
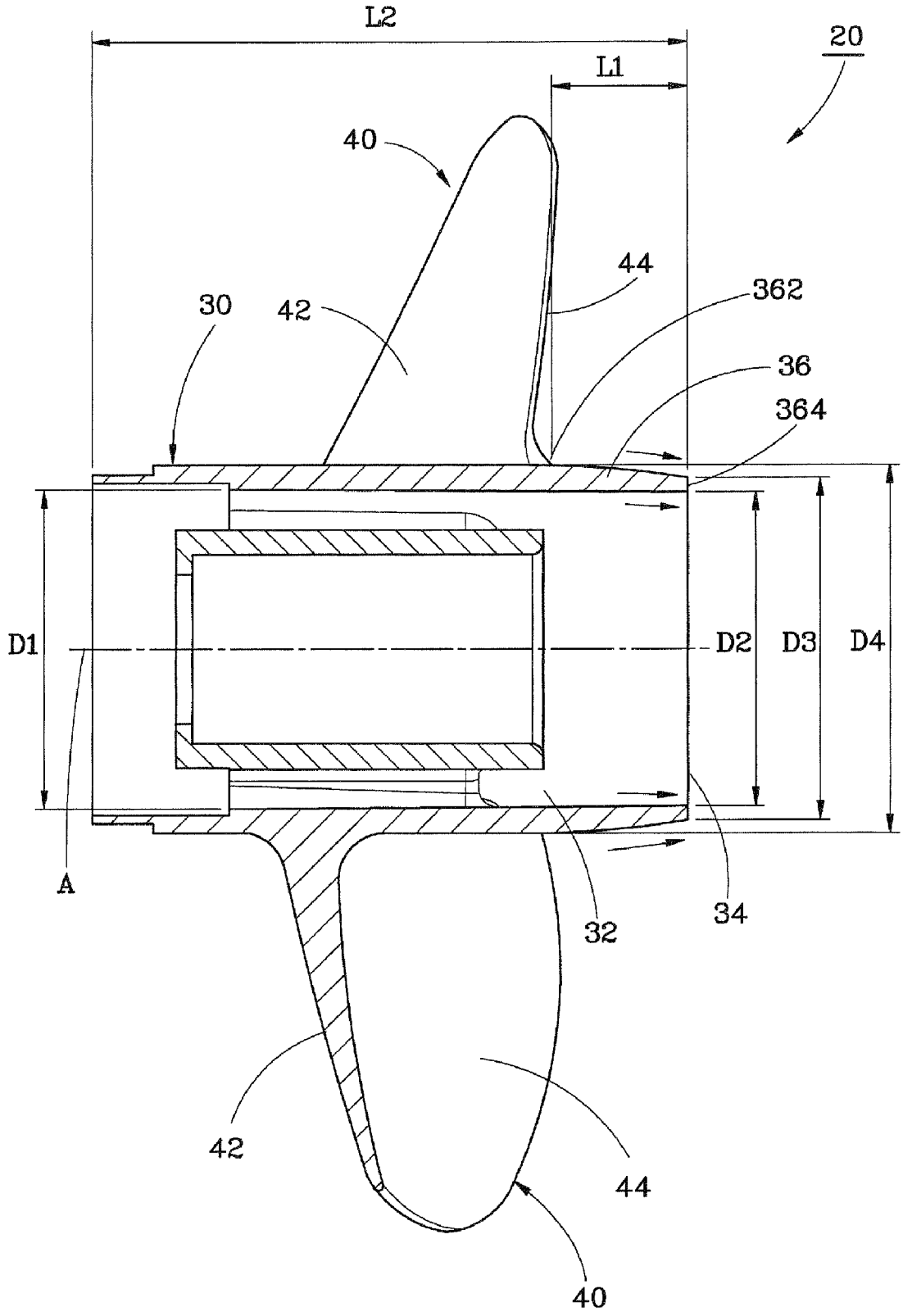
FIG. 3 is a longitudinal sectional view of a propeller according to a preferred embodiment of the present invention.

As shown in FIG. 3, a propeller 20 in accordance with a preferred embodiment of the present invention comprises a hub 30 and a plurality of blades 40.

The hub 30 has a center hole 32 defining a center axis A, and an outlet 34 in communication with the center hole 32. The diameter D1 of a front section of the center hole 32 can be greater than or equal to the diameter D2 of the outlet 34. Further, the hub 30 includes a tail portion 36 having a starting edge 362 and an end edge 364 with the outlet 34. The length L1 between the starting edge and the end edge of the tail portion 36 is longer than 25% of the total length L2 of the hub 30. In addition, the outer periphery, i.e. the external diameter, of the tail portion 36 defines with the center axis A a distance gradually decreasing toward the outlet 34, such that the external diameter D3 of the end edge 364 is smaller than 95% of the external diameter D4 of the starting edge 362.

The blades 40 are equiangularly disposed on the outer periphery of the hub 30 and each provided with a face 42 and a trailing edge 44. The root of the trailing edge 44 of each blade 40 is adjoined with the starting edge 362 of the tail portion 36 of the hub 30.

When the propeller 20 is driven to rotate by an engine (not shown), vortices are generated due to the rotation of the blades 40 and shed downstream, and simultaneously the waste gas produced from the engine will be exhausted out of the outlet 34 of the hub 30 through the center hole 32 of the hub 30. However, since the distance defined between the outer periphery of the tail portion 36 and the center axis A of the hub 30 gradually decreases toward the outlet 34, i.e. the tail portion 36 of the hub 30 is gradually shrunken in its external diameter, the water flowing along the outer periphery of the tail portion 36 can flow downstream more smoothly. At the moment of the water flow leaving the end edge 364 of the tail portion 36, the water will be drawn by the waste gas exhausted out of the outlet 34 to cause acceleration thereof, thereby reducing the drag and increasing the propulsive force of the boat when the propeller 20 rotates.

Besides, the propeller 20 of the present invention is an integrated design without installing an end cover such that the propeller 20 of the present invention has the advantages of reducing the manufacturing cost, preventing the corrosion by seawater, and enhancing the structural strength.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A propeller comprising:

a hub defining a center axis and having a tail portion with an outlet, said tail portion having an outer periphery defining with said center axis a distance gradually decreasing toward said outlet, the outer periphery having a front straight part and a taper-shaped rear part extending from the front straight part and radially decreasing toward the outlet; and a plurality of blades equiangularly disposed on an outer periphery of said hub, wherein said hub has a center hole defining said center axis and being in communication with said outlet; a diameter of said center hole is greater than or equal to a diameter of said outlet.

2. The propeller as claimed in claim 1, wherein said blades each have a trailing edge with a root adjoined with said tail portion of said hub.

3. The propeller as claimed in claim 2, wherein said tail portion of said hub includes a starting edge adjoined with said roots of said trailing edges of said blades, and an end edge having said outlet; an external diameter of said end edge is smaller than 95% of an external diameter of said starting edge.

4. The propeller as claimed in claim 2, wherein the length of said tail portion is longer than 25% of the total length of said hub.

* * * * *